US009723887B2

(12) United States Patent
Kim

(10) Patent No.: US 9,723,887 B2
(45) Date of Patent: Aug. 8, 2017

(54) HELMET AND A METHOD FOR DEALING WITH AN ACCIDENT USING THE HELMET

(71) Applicant: KMW INC., Hwaseong, Gyeonggi-do (KR)

(72) Inventor: Duk Yong Kim, Youngin (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 170 days.

(21) Appl. No.: 14/536,050

(22) Filed: Nov. 7, 2014

(65) Prior Publication Data

US 2015/0061874 A1 Mar. 5, 2015

Related U.S. Application Data

(63) Continuation of application No. PCT/KR2013/002975, filed on Apr. 9, 2013.

(30) Foreign Application Priority Data

May 8, 2012 (KR) ..... 10-2012-0048632

(51) Int. Cl.
*G08B 23/00* (2006.01)
*A42B 3/04* (2006.01)
(Continued)

(52) U.S. Cl.
CPC ..... *A42B 3/046* (2013.01); *A42B 3/0446* (2013.01); *A42B 3/0453* (2013.01); *A42B 3/285* (2013.01);
(Continued)

(58) Field of Classification Search
CPC ..... A42B 3/0446; A42B 3/0453; A42B 3/046; A42B 3/285; A42B 3/30; G08B 21/0446
See application file for complete search history.

(56) References Cited

U.S. PATENT DOCUMENTS 5,329,637 A * 7/1994 Walker ..... A42B 3/044 2/5
5,847,651 A * 12/1998 Lu ..... G08B 21/0446 2/410
(Continued)

FOREIGN PATENT DOCUMENTS

CN 1953675 A 4/2007
CN 201905294 U 7/2011
(Continued)

OTHER PUBLICATIONS

A Second Office Action for corresponding Chinese Patent Application No. 201380024087.X dated Jun. 29, 2016.
(Continued)

*Primary Examiner* — Brian Zimmerman
*Assistant Examiner* — Thomas McCormack
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a helmet and a method for dealing with an accident using the helmet, which the helmet includes: a helmet body part made of a resin having a semi-spherical space for receiving the head of a wearer; a light part arranged in the front of the helmet body part having LEDs mounted on a substrate to provide the wearer with lighting; a metallic heat radiator extending from the front of the helmet body part to the back thereof along the upper central line of the helmet body part and partially contacting the back of the substrate to discharge heat; a communication device part received in the helmet body part for dealing with communication and emergency circumstances; and a battery received in the helmet body part for supplying power to the communication part and light part. According to the present invention, the metallic heat radiator is integrated with the resinous helmet body part by injection
(Continued)

molding of different materials, so that the heat generated from the LEDs of the light part is discharged upwards from the top of the helmet, thus preventing the wearer from being subjected to the discomfort caused by the heat generated from the LEDs.

19 Claims, 6 Drawing Sheets

(51) Int. Cl.

| | |
|---|---|
| ***A42B 3/30*** | (2006.01) |
| ***F21L 4/04*** | (2006.01) |
| ***F21V 7/00*** | (2006.01) |
| ***F21V 29/00*** | (2015.01) |
| ***G08B 21/04*** | (2006.01) |
| ***A42B 3/28*** | (2006.01) |
| *F21W 131/402* | (2006.01) |
| *F21Y 115/10* | (2016.01) |

(52) U.S. Cl.
CPC *A42B 3/30* (2013.01); *F21L 4/04* (2013.01); *F21V 7/0083* (2013.01); *F21V 29/004* (2013.01); *G08B 21/0446* (2013.01); *F21W 2131/402* (2013.01); *F21Y 2115/10* (2016.08)

(56) References Cited

U.S. PATENT DOCUMENTS

| | | | | |
|---|---|---|---|---|
| 7,721,349 | B1 * | 5/2010 | Strauss | A41D 13/0053 2/102 |
| 8,117,676 | B1 * | 2/2012 | Cardoso | A42B 3/044 2/410 |
| 2003/0071766 | A1 * | 4/2003 | Hartwell | A42B 3/30 345/8 |
| 2005/0174753 | A1 * | 8/2005 | Cao | A42B 3/044 362/106 |
| 2006/0277666 | A1 | 12/2006 | Gertsch et al. | |
| 2009/0002161 | A1 | 1/2009 | Luciani | |
| 2009/0040308 | A1 | 2/2009 | Temovskiy | |
| 2010/0181988 | A1 * | 7/2010 | Hong | G06F 1/1626 323/318 |
| 2011/0234403 | A1 * | 9/2011 | Niederer, III | A42B 3/227 340/540 |

FOREIGN PATENT DOCUMENTS

| | | | |
|---|---|---|---|
| CN | 201948059 | U | 8/2011 |
| CN | 201967775 | U | 9/2011 |
| JP | 3037323 | U | 5/1997 |
| JP | 2007-538169 | A | 12/2007 |
| JP | 2010-515876 | A | 5/2010 |
| JP | 2010-148718 | A | 7/2010 |
| KR | 20-0374906 | Y1 | 2/2005 |
| KR | 10-2008-0031206 | | 4/2008 |
| KR | 10-2010-0089911 | | 8/2010 |
| KR | 10-2010-0115688 | | 10/2010 |
| KR | 20-0450780 | Y1 | 10/2010 |
| KR | 10-1050710 | B1 | 7/2011 |
| WO | WO-2010123188 | A1 | 10/2010 |
| WO | 2013076325 | A1 | 5/2013 |

OTHER PUBLICATIONS

Office Action dated Jan. 18, 2017 in corresponding Chilean Patent Application No. 201403033 (w/English translation of pertinent information).

* cited by examiner

HELMET AND A METHOD FOR DEALING WITH AN ACCIDENT USING THE HELMET

CROSS-REFERENCE TO RELATED APPLICATIONS

This application is a continuation of International Application No. PCT/KR2013/002975 filed on Apr. 9, 2013, which claims priority to Korean Application No. 10-2012-0048632 filed on May 8, 2012. The applications are incorporated herein by reference.

TECHNICAL FIELD

The present invention relates to a safety helmet and a method of handling an accident using the safety helmet, and more particularly to a safety helmet which realizes a philosophy of respecting the life of an operator first and a method of handling an accident using the safety helmet.

BACKGROUND ART

In general, it is dictated by law that a person who enters an industrial field such as a construction field, a shipyard, or a mine must wear a safety helmet. The safety helmet functions to protect the head of the wearer from an external impact.

Generally, the safety helmet is not integrally provided with a headlamp, and the headlamp is fixed to an outer circumference of the safety helmet using a fixing string for fixing the headlamp. This normally prevents the wearer from feeling a weight feeling or a discomfort due to the safety helmet by reducing the weight of the safety helmet, and is particularly due to an environment in which surroundings can be identified by peripheral lighting even in the case a headlamp is not used.

However, when a power outage occurs due to a fire or the like, the worker may become lost if he or she does not carry a separate headlamp or lighting unit and it is difficult for the worker to promptly evacuate.

Accordingly, it is necessary to fix, to the safety helmet, a headlamp having a weight light enough not to cause a heavy feeling or discomfort to a An LED is suitable for a lighting means which is lightweight, consumes little power of a battery, and emits light of a high luminance.

A safety helmet which employs an LED as a headlamp is disclosed in Korean Utility Model No. 20-0450780 (published on Oct. 26, 2010). Korean Utility Model No. 20-0450780 has a configuration in which an LED lighting unit is rotatably installed to be accommodated within a shield part of a safety helmet such that the LED lighting unit can be exposed if necessary.

However, there is no structure for emitting heat generated by the LED installed in the safety helmet in the description of the utility model, and the wearer may feel uncomfortable due to the heat generated by the LED when the LED protrudes downward from a lower side of the shield part.

Further, the life span of the LED is rapidly shortened by the heat directly generated by the LED.

There are prior technologies which provide a safety helmet with a means for detecting an accident of the wearer in addition to the LED lighting unit, and an example of the technologies is disclosed in Korean Patent Application Publication No. 10-2010-0089911.

Korean Patent Application Publication No. 10-2010-0089911 provides a sensor for detecting an impact as a means for detecting an accident, and it technically has a meaning in realization of the functionality of a safety helmet because it is difficult to detect fatigue or a fainting of the user which is an accident not accompanied by an impact or an impact to an human body part other than the head, but it cannot guarantee the safety and life of the wearer as the first priority.

SUMMARY

The present invention has been made in an effort to solve the above-mentioned problems, and provides a safety helmet with which a headlamp using an LED is integrally formed such that the wearer does not feel uncomfortable due to heat generated by the LED.

The present invention also provides a safety helmet which can prevent the lift span of an LED applied to a safety helmet integrated headlamp from being shortened.

The present invention also provides a safety helmet which can detect accidents of various causes in addition to a direct impact by continuously determining a state of consciousness of the wearer.

The present invention also provides a method of handling an accident using a safety helmet through which if an accident is detected, information such as an accident location, or a chronic disease or a state of health of the wearer can be automatically transmitted according to a consciousness of the wearer.

In accordance with an aspect of the present invention, there is provided a safety helmet including:

a safety helmet body formed of a resin, for providing a semispherical space to accommodate the head of a human body;

a lighting part provided at a front side of the safety helmet body, for accommodating a substrate having an LED to provide lighting on a front side of a helmet wearer;

a metallic heat radiation part extending from a front side to a rear side of the safety helmet body along the center of an upper portion of the safety helmet body, for radiating heat while contacting a rear surface of the substrate;

a communication unit accommodated in the safety helmet body, for handling communication and occurrence of an emergency situation; and a battery accommodated in a battery accommodation space, for supplying electric power to the communication unit and the lighting part.

In accordance with another aspect of the present invention, there is provided a method of handling an accident using a safety helmet, the method including the steps of: a) determining an accident using a detection means if a state in which there is no motion of a wearer continues for a set time period or more; b) outputting a voice signal through a consciousness identification means such that the determination of an accident is identified and a state of consciousness of the wearer is identified; and c) when the wearer is determined to be unconscious in step b), reporting information of the accident stored in a memory to a rescue team through a reporting means.

In the safety helmet according to the present invention, a metallic heat radiation part and a safety helmet body formed of a resin are coupled to each other through dissimilar injection-molding, whereby heat generated by an LED used as a lighting unit is emitted to an upper side of the safety helmet so that the wearer does not feel uncomfortable due to the heat generated by the LED.

Further, in the safety helmet according to the present invention, the life span of an LED can be prevented from being shortened due to heat generated by the LED by easily emitting the heat to the outside through the heat radiation part.

In addition, in the safety helmet and the method of handling an accident using the safety helmet, when an accident occurs, a state of consciousness of the wearer can be determined with a philosophy of respecting the life of the wearer first, and an accident location and wearer information are automatically transmitted to a rescue team when the wearer is unconscious, whereby a measure which is irrespective of the cause of an accident can be realized.

DETAILED DESCRIPTION

Hereinafter, a safety helmet and a method of handling an accident using the safety helmet according to exemplary embodiments of the present invention will be described in detail with reference to the accompanying drawings.

Figure 1:
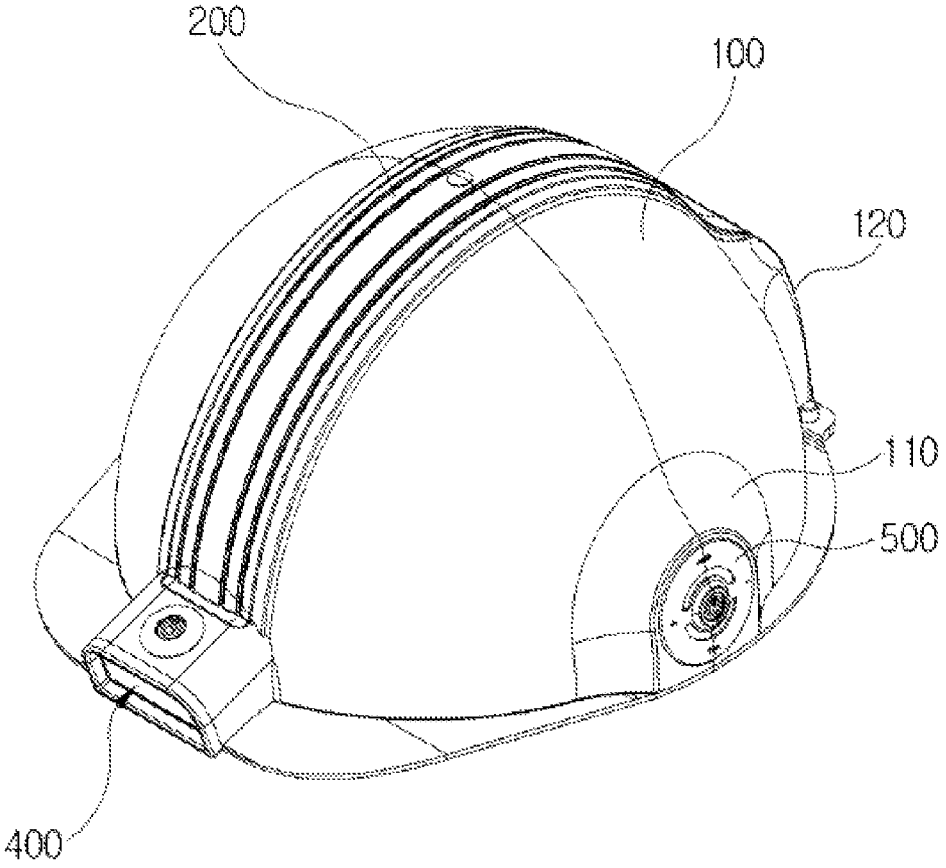
FIG. 1 is an exploded perspective view of a safety helmet according to an embodiment of the present invention.
Figure 2:
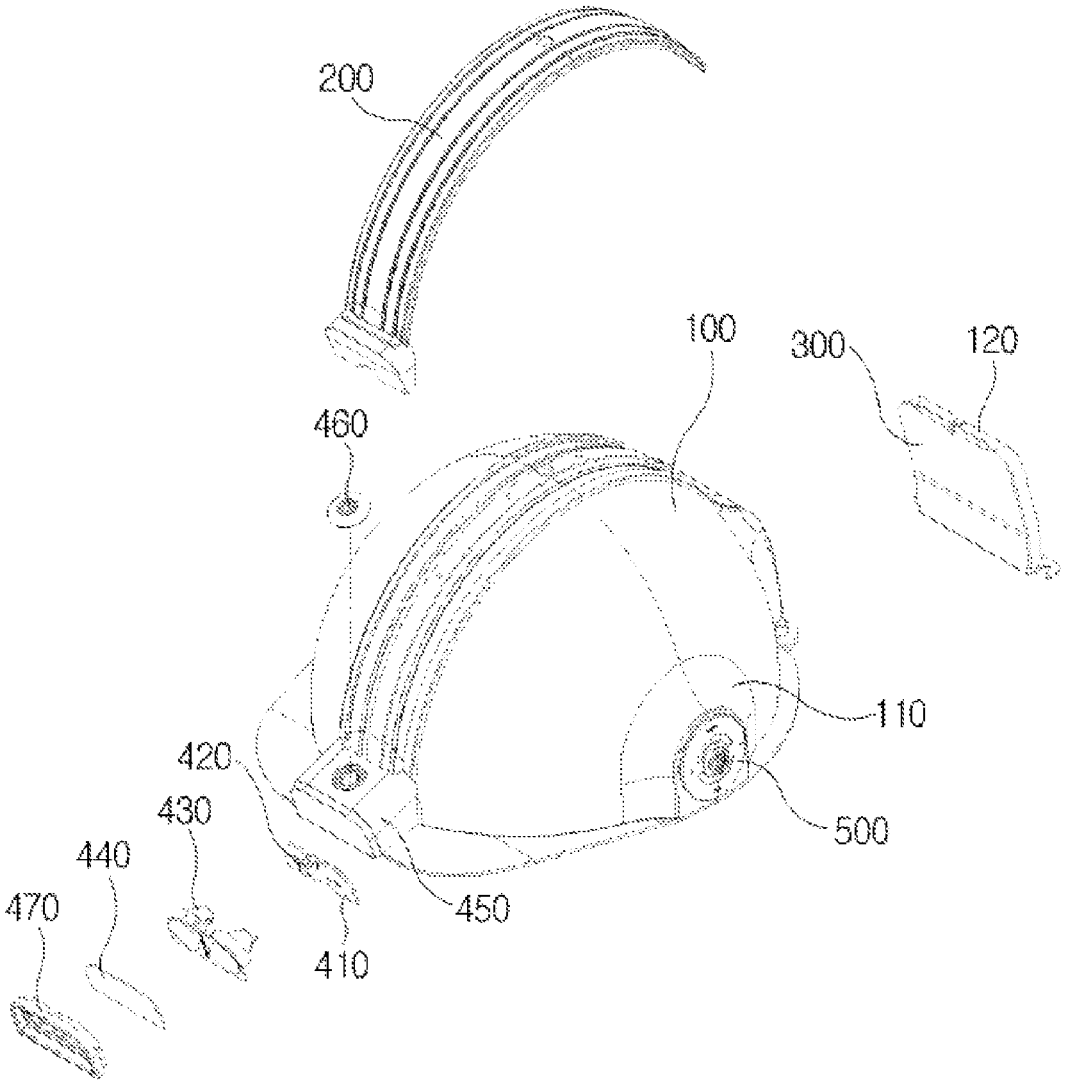
FIG. 2 is a view showing a coupled state of FIG. 1.
Figure 3:
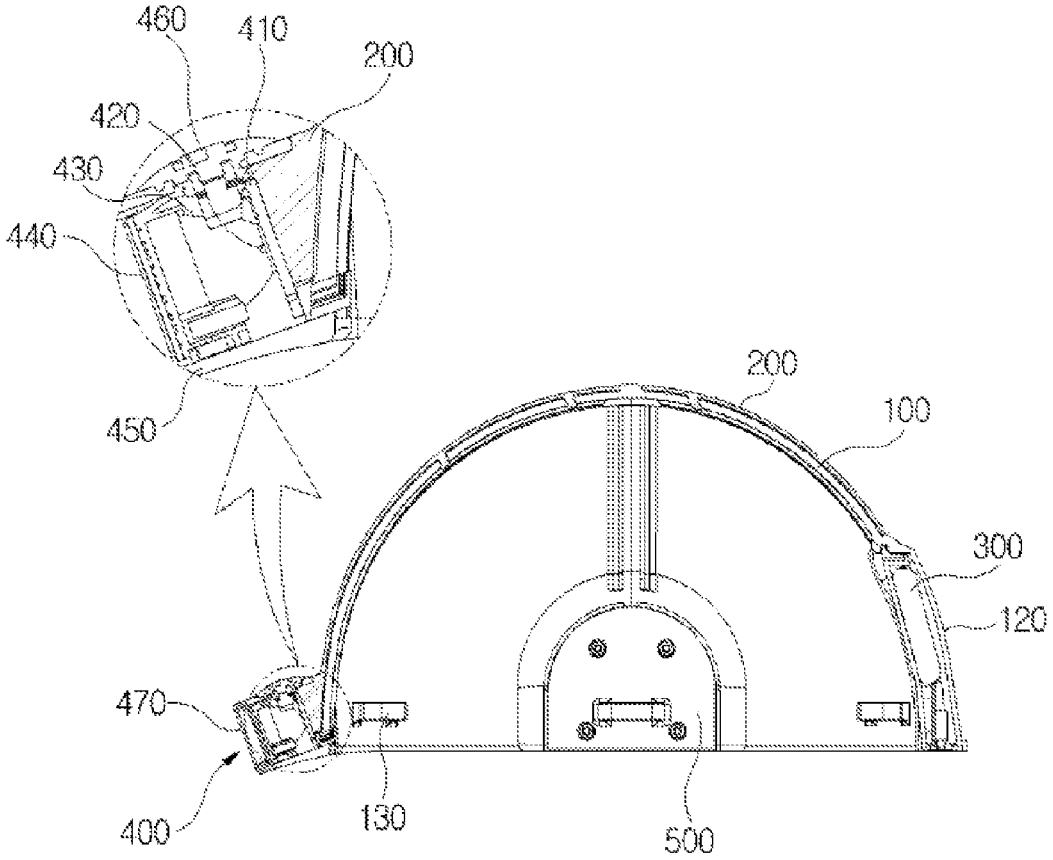
FIG. 3 is a sectional view of FIG. 1.

FIG. 1 is an exploded perspective view of a safety helmet according to an exemplary embodiment of the present invention. FIG. 2 is a view showing a coupled state of FIG. 1. FIG. 3 is a sectional view of FIG. 1.

Referring to FIGS. 1 to 3, the safety helmet according to an exemplary embodiment of the present invention includes a safety helmet body 100 formed of a resin, for providing a semispherical space to accommodate the head of a human body, a lighting part 400 provided at a front side of the safety helmet body 100, for accommodating a substrate 410 having an LED 420 to provide lighting on a front side of a helmet wearer, a metallic heat radiation part 200 extending from a front side to a rear side of the safety helmet body 100 along the center of an upper portion of the safety helmet body 100, for radiating heat while contacting a rear surface of the substrate 410, a communication unit 500 accommodated in an accommodation space 110 partially protruding from a side of the safety body 110, and a battery 300 accommodated in a battery accommodation space 120 at a rear side of the safety helmet body 100, for supplying electric power to the communication unit 500 and the lighting part 400.

Hereinafter, a configuration and an operation of the safety helmet according to the exemplary embodiment of the present invention will be described in detail.

First, when the safety helmet body 100 and the heat radiation part 200 are formed of a resin and a metal, respectively, the heat radiation part 200 is inserted into a mold to be coupled to the safety helmet body 100 when the safety helmet body 100 is injection-molded, after being integrally processed.

The shape of the safety helmet body 100 corresponds to a structure having a semispherical space therein to accommodate the head of a human body. Of course, if necessary, an inner sheath such as Styrofoam may be applied to an inside of the safety helmet body 100.

An accommodation space 110 partially protruding from the semispherical structure while not contacting the wearer is provided at a side surface of the safety helmet body 100, and a battery accommodation space 120 for providing a space for accommodating the battery 300 is provided on a rear surface of the safety helmet body 100.

A lighting part case 450 of which a front side is opened and having a recess to which a switch 460 is coupled at an upper portion thereof is also integrally injection-molded with the safety helmet body 100.

Then, one end of the heat radiation part 200 is inserted into an inside of the lighting part case 450, and thereafter, the substrate 410 having the LED 420 is configured to contact the heat radiation part 200 located in an inside of the lighting part case 450 such that heat emitted from the LED 420 may be more effectively transferred to the heat radiation part 200 to be radiated.

Figure 4:
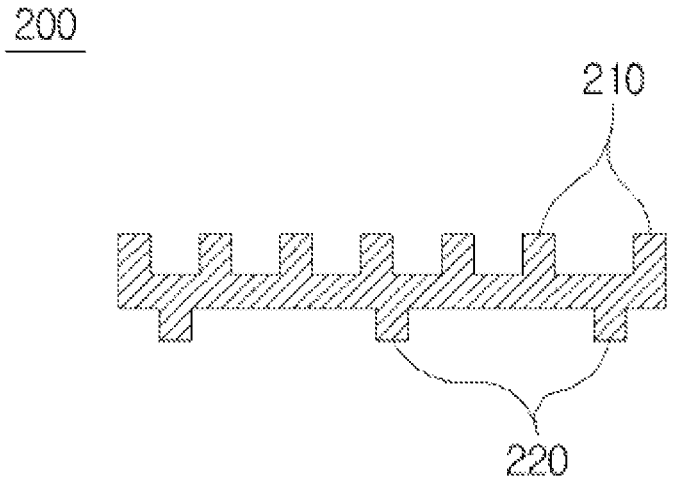
FIG. 4 is a sectional view of a heat radiation part of FIG. 1.

FIG. 4 is a sectional view of the heat radiation part 200.

Referring to FIG. 4, heat radiation fins 210 are arranged in a lengthwise direction of the heat radiation part 200, and a plurality of protrusions 220 are provided on a bottom surface of the heat radiation part 200.

The heat radiation fins 210 may increase heat radiation efficiency by increasing a surface area of the heat radiation part 200, and the plurality of protrusions 220 may allow the safety helmet body 100 to be more firmly jointed.

The heat radiation fins 210 function as reinforcing ribs, thereby increasing strength of the safety helmet body 100 while minimizing an increase in the entire weight of the safety helmet body 100.

A battery accommodation space 120 is provided on a rear surface of the safety helmet body 100 spaced apart from the heat radiation part 200. The battery accommodation part 120 provides a space of a predetermined volume, and the battery is accommodated in the battery accommodation part 120 to supply electric power to the substrate 410 and the communication unit 500.

The lighting part 400 is configured such that the LED 420 is operated by supplying electric power of the battery 300 to the substrate 410 through manipulation of the switch 460 by the wearer, and is provided with a reflection part 430 for limiting an emission angle of light and a lens 440 to project light of the LED 420 at a predetermined angle for lighting.

The lens 440 may be replaced by a transparent or semi-transparent cover in consideration of light efficiency.

Figure 5:
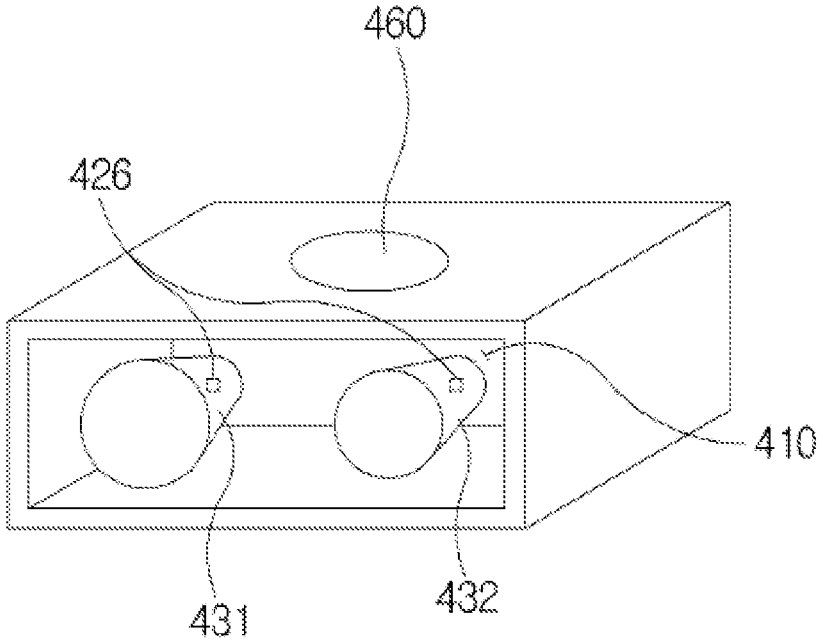
FIG. 5 is a diagram of an embodiment of a lighting part applied to the safety helmet of the present invention.

FIG. 5 is a diagram of another embodiment of the lighting part 400.

Referring to FIG. 5, the lighting part includes a plurality of LEDs 420, and the LEDs 420 may have reflection parts 431 and 432 having different radiation angles, respectively.

That is, the LEDs 420 corresponding to the reflection parts 431 and 432 having a specific radiation angle may be selected by manipulating the switch 460 to supply electric power, and light having a wide radiation angle and light having a narrow radiation angle may be selected and used.

In this way, the present invention can allow the wearer to select intensive light or general light according to the operation, thereby improving convenience.

Figure 6:
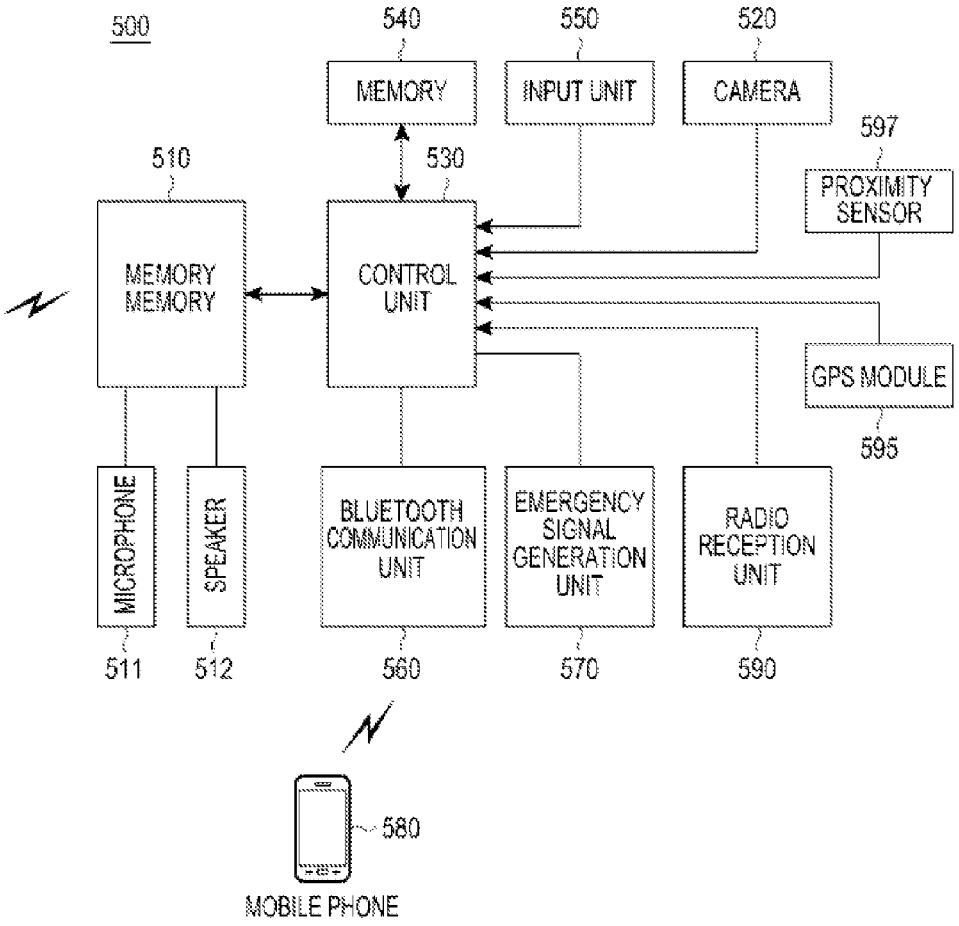
FIG. 6 is a diagram of an embodiment of a communication unit applied to the present invention.

FIG. 6 is a diagram of an embodiment of a communication unit applied to the present invention.

Referring to FIG. 6, the communication unit 500 applied to the safety helmet according to the present invention includes a communication module 510 coupled to an inside or an outside of the safety helmet body 100, in detail, for performing wireless communication with another neighboring communication unit 500, a camera 520 for photographing an image, a control unit 530 for storing images photographed by the camera 520 at a predetermined period, including the stored images to determine an accident, and controlling handling of an accident if the accident is determined as having occurred, an input unit 550 for allowing the wearer to perform a control input, an emergency signal generation unit 570 for generating an emergency signal under the control of the control unit 530, a Bluetooth communication unit 560 for communicating with a mobile phone 580 of the wearer to request a rescue under the control of the control unit 530 in the case of an accident, a radio reception unit 590 for receiving a radio broadcast, a GPS module 595 for receiving a GPS signal, and a proximity sensor 597 for identifying a wearing state of the safety helmet and if the safety helmet is not worn, informing the control unit 530 that the wearing state is released to stop the communication module 510 including a microphone 511 and a speaker 512.

Hereinafter, a method of handling an accident using the above-configured safety helmet provided with a communication unit will be described.

First, normally, an image photographed by the camera 520 may be transmitted to a nearby manager terminal through the communication module 510 to allow the manager to identify the contents of the operation or display the contents of the operation on a terminal of a leader when the safety helmet is used in a leisure activity such as mountain climbing, or operators, a manager and an operator, or mountain climbers may perform voice communication by using the microphone 511 and the speaker 512. Hereinafter, the communication module 510, the microphone 511, and the speaker 512 are generally referred to as a communication unit.

In leisure activities such as mountain climbing, a radio broadcast may be received by the radio reception unit 590 and may be listened to through the speaker 512.

According to the present invention, because the microphone 511 and the speaker 512 are adjacent to each other, when a space is produced between the microphone 511 and the speaker 512 while electric power is supplied to the communication module 510, that is, the wearer takes off the safety helmet, howling occurs so that a howling sound may be generated through the speakers 512 of other users.

Howling can be prevented by cutting off electric power of the communication module 510 when the safety helmet is taken off, by detecting the wearing state of the safety helmet using the proximity sensor 597.

The control unit 530 stores images of the camera 520 in a memory 540 as still image data at a predetermined period, and compares the still image data stored at a previous period with the currently stored still image data.

After repeatedly performing the comparisons, generation of an accident is primarily determined if a state in which a motion of the wearer is not detected continuously for a predetermined time period.

The control unit 530, the camera 520, and the memory 540 act as a detection means for detecting an accident, and it will be described below that the camera 520 may be replaced by a gyro sensor.

That is, still images are stored in the memory 540 at an interval of 10 seconds, and if a state having no motion continues for one minute after the comparison of the still images, an accident is determined as having occurred.

An accident also may be recognized by a chronic disease or a state of health of the wearer or leakage of a specific gas in the field through the determination method even when an external impact is not applied. This can place the highest value on the life of the wearer as compared with a safety helmet which detects an impact directly applied to the safety helmet according to the related art.

That is, the detection means applied to the present invention detects the state of the wearer as a result, and detects an accident while paying attention to the result rather than the cause of the accident.

In addition to the primary determination method for an accident using the camera 520, a sensor for detecting a motion of a gyro sensor (not shown) may be used. That is, a state in which a motion is not detected by a sensor for detecting a motion continues for a preset time or more, an accident may be primarily determined as having occurred.

If an accident is determined as having occurred, the control unit 530 identifies whether an accident has actually occurred, whether the wearer concentrates on work and is not moving at all, or whether the wearer is conscious when an accident occurs through a consciousness identification means including the memory 540, the control unit 530, and the speaker 512.

This reproduces a voice signal stored in the memory 540 through the speaker 512 and requests a response from the wearer. An example of the voice signal may be a question such as "Master, are you OK?", and if the wearer pushes a specific button of the input unit 550 or speaks, the control unit 530 determines that an accident did not occur or that the wearer is conscious even though an accident has occurred.

That is, after the voice signal is output, the control unit 530 identifies whether a voice signal is input through the microphone 511 or the input unit 550 within a predetermined time period, and determines that an accident did not occur or that the wearer is conscious even when an accident has occurred if a voice is input or an input signal is input through the input unit 550.

When the wearer is conscious, an emergency button provided in the input unit 550 is pushed to report the accident. The reporting of the accident follows an operation which is the same as or similar to the case of the operator not being unconscious which will be described below, and a detailed description thereof will be omitted.

To the contrary, if neither a voice nor an input signal is input, the control unit 530 finally determines that the wearer is unconscious, and generates an emergency signal through the emergency signal generation unit 570 and connects to the portable terminal 580 of the wearer through the Bluetooth communication unit 560, which is a report means, to request a rescue from an emergency services center.

Then, the rescue request contents may be voice data stored in the memory 540 in advance, text messages, or communication data stored in advance, and the rescue request contents may include the name, the gender, the blood type, the age, the chronic disease, and the past disease history of the wearer, and may include a current location of the accident using GPS data received by the GPS module 595.

That is, the information of the wearer is stored in advance, and is collectively transmitted to the rescue team to aid in the rescue operation.

Further, surrounding colleagues may be informed of the generation of the accident. The voice signal stored in the memory 540 may be transmitted to be reported through the communication module 510, and a short text message may be collectively transmitted to stored phone numbers.

According to the present invention, an accident due to various causes can be determined irrespective of the causes, and the generation of the accident can be automatically reported and handled even when the accident sufferer is unconscious, whereby the value of respect of a life can be realized.

Further the present invention can be applied to a wide range of applications. For example, according to the present invention, an accident which may occur during a leisure activity such as rafting or cycling can be automatically handled, and a mission can be easily performed using a military safety helmet and an accident can be automatically handled as well.

In addition, for example, senior citizens who live alone often freeze to death while sweeping snow, which recently has been an issue, in which case, accidents or states of consciousness of the senior citizens who cannot be cared for by neighbors can be automatically transmitted to hospitals or emergency service centers, whereby the senior citizens' problems can be solved.

It will be appreciated by those skilled in the art to which the present invention pertains that the present invention is not limited to the embodiment and may be variously modified without departing from the spirit of the present invention.

The present invention uses a lighting part employing LEDs in a safety helmet, and solves inconvenience due to radiation of heat of the LEDs, and identifies occurrence of an accident of a helmet wearer to automatically take a measure according to the result, thereby achieving industrial applicability of providing the wearer with safety and convenience.

The invention claimed is:

1. A safety helmet comprising:

a safety helmet body formed of a resin, for providing a semispherical space to accommodate the head of a human body;

a lighting part provided at a front side of the safety helmet body, for accommodating a substrate having an LED to provide light to a front side of a helmet wearer;

a metallic heat radiation part extending from a front side to a rear side of the safety helmet body along the center of an upper portion of the safety helmet body, for radiating heat while contacting a rear surface of the substrate;

a communication unit accommodated in the safety helmet body, for handling communication and occurrence of an emergency situation, automatically detecting the accident and reporting the accident when the accident occurs; and a battery accommodated in a battery accommodation space, for supplying electric power to the communication unit and the lighting part, wherein the communication unit comprises:

a microphone;

a camera that produces image data;

a memory that stores voice and image data;

a speaker; and a control unit, wherein the microphone and the camera provide voice and data communication based on detection of an accident by the comparison of information stored in the memory and the image data produced by the camera, wherein the speaker, the memory and the control unit are configured to identify whether a wearer is conscious when an accident occurs based on an action of the wearer, and wherein the emergency signal generator, reports if the wearer is unconscious.

2. The safety helmet of claim 1, wherein the safety helmet body and the heat radiation part are coupled to each other through dissimilar injection-molding.

3. The safety helmet of claim 1, wherein a plurality of heat radiation fins are provided at an upper portion of the heat radiation part, and protrusions are provided at a lower portion of the heat radiation part to be coupled to the safety helmet body.

4. The safety helmet of claim 1, wherein two or more LEDs are mounted to the substrate, and the LEDs comprise reflection parts for limiting light emission angles such that the light emission angels of the LEDs are different from each other.

5. The safety helmet of claim 1, wherein the communication unit further comprises:

images photographed by the camera and stored in the memory as still images of a predetermined period, that determine that an accident has occurred if there is no change in the images for a set time period.

6. The safety helmet of claim 1, wherein the communication unit reproduces a voice signal stored in the memory through the speaker, and identifies whether the wearer's voice input through the microphone or an input through an input unit is present within a predetermined time period.

7. The safety helmet of claim 1, wherein the communication unit further comprises:

a radio reception unit configured to receive a radio broadcasting signal;

a GPS memory configured to receive GPS data; and a proximity sensor configured to detect a wearing state of the safety helmet, and stopping an operation of the communication means if the safety helmet is not worn.

8. A method of handling an accident using the safety helmet of claim 1, comprising:

determining that the accident has occurred based on the absence of motion of the wearer that continues for a set time period or more;

outputting a voice signal to request a response of the wearer to determine occurrence of the accident and the conscious state of the wearer to an emergency signal generation unit; and reporting information about the accident when the wearer is determined to be unconscious.

9. The method of claim 8, wherein determining that the accident has occurred includes: detecting a motion of the wearer by detection images photographed by the camera at a predetermined period.

10. The method of claim 8, wherein determining that the accident has occurred includes: detecting a motion of the wearer by using a gyro sensor.

11. The method of claim 8, wherein outputting the voice signal includes:

outputting the voice signal input to the memory in advance through the speaker; and identifying whether a voice of the wearer or an input signal through an input unit is input to determine that the wearer is unconscious if there is no input.

12. The method of claim 8, wherein reporting information includes, using a mobile phone of the wearer to report via a Bluetooth communication.

13. The method of claim 8, wherein the content of the accident report includes least one from a group consisting of a name, a gender, a blood type, an age, a chronic disease, a past disease history, and location information of the wearer.

14. A method of handling an accident using a safety helmet, comprising:

determining that an accident has occurred using a communication unit if a state in which there is no motion of a wearer continues for a set time period or more based on voice and data received from a microphone and a camera that detect the accident by a comparison of information stored in a memory and an image data produced by the camera;

outputting a voice signal through a control unit configured to determine the occurrence of an accident and a conscious state of the wearer based on an action of the wearer; and reporting information of the accident stored in the memory to a rescue team through the emergency signal generation unit when the wearer is determined to be unconscious.

15. The method of claim 14, wherein determining that an accident has occurred includes: a motion of the wearer is detected by detecting images photographed by the camera at a predetermined period.

16. The method of claim 14, wherein determining that an accident has occurred includes: detecting a motion of the wearer using a gyro sensor.

17. The method of claim 14, wherein outputting a voice signal further includes: inputting a voice signal to the memory in advance is output through a speaker; and identifying whether a voice of the wearer or an input signal through an input unit is input to determined when the wearer is unconscious if there is no input.

18. The method of claim 14, wherein reporting includes that an accident is reported through connection to a mobile phone of the wearer using a Bluetooth communication.

19. The method of claim 14, wherein the content of the accident report includes least one from a group consisting of a name, a gender, a blood type, an age, a chronic disease, a past disease history, and location information of the wearer.

* * * * *